US006340129B1

(12) United States Patent
Haasen et al.

(10) Patent No.: US 6,340,129 B1
(45) Date of Patent: Jan. 22, 2002

(54) METHOD FOR OPERATING A WORKSTATION OF A CHEESE-PRODUCING TEXTILE MACHINE

(75) Inventors: Rolf Haasen, Mönchengladbach; Hans-Günter Wedershoven, Nettetal; Bernd-Rüdiger Theele, Aachen, all of (DE)

(73) Assignee: W. Schlafhorst AG & Co. (DE)

( * ) Notice: Subject to any disclaimer, the term of this patent is extended or adjusted under 35 U.S.C. 154(b) by 0 days.

(21) Appl. No.: 09/501,463

(22) Filed: Feb. 9, 2000

(30) Foreign Application Priority Data

Feb. 12, 1999 (DE) ..... 199 05 860

(51) Int. Cl.[7] ..... B65H 23/24; B65H 59/20

(52) U.S. Cl. ..... 242/419.1; 242/150 M; 242/419.3; 242/419.4

(58) Field of Search ..... 242/419.1, 419.3, 242/419.4, 147 M, 150 M

(56) References Cited

U.S. PATENT DOCUMENTS

| | | | | |
|---|---|---|---|---|
| 4,830,296 A | | 5/1989 | Ueda et al. | |
| 4,880,175 A | * | 11/1989 | Yamauchi et al. | 242/150 M |
| 5,046,673 A | * | 9/1991 | Moussalli | 242/150 M |
| 5,294,071 A | | 3/1994 | Hartel et al. | |
| 5,301,887 A | | 4/1994 | Wirtz et al. | |
| 5,301,895 A | * | 4/1994 | Sheehan et al. | 242/150 M |
| 5,329,822 A | | 7/1994 | Hartel et al. | |
| 5,676,329 A | * | 10/1997 | Bertoli et al. | 242/150 M |
| 5,853,137 A | | 12/1998 | Straaten et al. | |
| 5,857,637 A | * | 1/1999 | Straaten et al. | 242/150 M |
| 5,871,163 A | * | 2/1999 | Bertoli et al. | 242/147 M |
| 6,095,449 A | * | 8/2000 | Gallo et al. | 242/150 M |

FOREIGN PATENT DOCUMENTS

| | | |
|---|---|---|
| DE | 34 35 436 A1 | 4/1985 |
| DE | 37 18 924 A1 | 12/1987 |
| DE | 40 30 892 A1 | 4/1992 |
| DE | 40 32 617 A1 | 4/1992 |
| DE | 41 29 803 A1 | 3/1993 |
| DE | 41 30 301 A1 | 3/1993 |
| DE | 196 50 932 A1 | 6/1998 |
| JP | 8-12188 | 1/1996 |

* cited by examiner

*Primary Examiner*—Michael R. Mansen
(74) *Attorney, Agent, or Firm*—Kennedy Covington Lobdell & Hickman, LLP

(57) ABSTRACT

A method for operating a work station (10) of a cheese-making textile machine. A work station computer (32) communicates with a tensile yarn force sensor (54) for monitoring the tensile yarn force of a yarn (22) traveling from a supply bobbin (12) to a takeup bobbin (14). A yarn tensioner (36) regulates the tensile yarn force of this yarn and a yarn cutting device (52) performs a controlled severing of the running yarn. According to the invention, the work station computer (32) predetermines the contact pressure (APD) of a yarn braking device (114, 116) of the yarn tensioner (36) acting on the yarn (22) in accordance with the tensile yarn force ascertained by the tensile yarn force sensor (54), compares the predetermined contact pressure ($APD_{ist}$) with a predetermined contact pressure value ($APD_{max}$), and interrupts the bobbin winding process if the limit value is attained or exceeded for a predetermined time period ($t_2$–$t_1$).

8 Claims, 2 Drawing Sheets

METHOD FOR OPERATING A WORKSTATION OF A CHEESE-PRODUCING TEXTILE MACHINE

FIELD OF THE INVENTION

The present invention relates to a method for operating a work station of a cheeseproducing textile machine, having the characteristics recited in the preamble to claim 1.

BACKGROUND OF THE INVENTION

Such cheese-producing textile machines are known, for instance from German Patent Disclosure DE 196 50 932 A1. Such machines, so-called automatic cheese winders, have many work stations embodied as winding stations, which are typically disposed side by side longitudinally of the bobbin winding machine. For control and monitoring purposes, each winding station is assigned a separate work station computer. The individual work station computers are also connected to a central control unit of the bobbin winding machine, via a machine bus.

For supplying and removing tubes and bobbins to and from work stations, such automatic cheese winders typically have a logistics apparatus in the form of a bobbin and tube transport system. In this bobbin and tube transport system, supply bobbins, more commonly known as spinning cops, or empty tubes revolve while standing upright on the mandrels of transport trays.

Such bobbin winding machines also have a service unit in the form of a so-called cheese changer that automatically supplies the work stations. The cheese changer transfers finished fully wound takeup bobbins from the creel of the work station to a transport system of the same length as the machine, which system feeds the cheeses to a transfer station disposed at the end of the machine. The service unit then places a new empty tube in the creel of the applicable work station.

During the rewinding of the yarn from a supply bobbin to a takeup bobbin, it is known to monitor the traveling yarn by means of a tensile yarn force (i.e., yarn tension) sensor and to maintain the tensile yarn force at a predetermined level by means of a yarn tensioner. Thus, by means of the yarn tensioner, a substantially constant tensile yarn force of the running yarn is established, thereby t o assure uniform winding of the yarn on the takeup bobbin.

From German Patent Disclosure DE 41 29 803 A1, it is known to detect the current tensile yarn force of the running yarn using a tensile yarn force sensor. By means of a tensile yarn force measurement, made on the running yarn by this tensile yarn force sensor, a control signal for the yarn tensioner is furnished, and in accordance with the control signal the yarn tensioner exerts a more or less major braking action on the running yarn. To that end, the yarn tensioner has a yarn braking device that can be acted upon by a variable contact pressure. Such a yarn tensioner is known for instance from German Patent Disclosure DE 41 30 301 A1. By the cooperation of the tensile yarn force sensor with the yarn tensioner, it is assured that the yarn is wound onto the takeup bobbin with a defined tensile yarn force.

In the tensile yarn force sensor known from German Patent Disclosure DE 41 29 803 A1, the yarn is guided via a yarn guide element, which is mounted on a head end of a plunger coil disposed in a magnetic field. With this kind of tensile yarn force sensor, a plunger coil current for holding the position of the plunger coil can be taken as a direct variable for the tensile yarn force, since a proportional dependency exists between the tensile yarn force and the plunger coil current. The course of the tensile yarn force can thus be monitored by evaluating the plunger coil current.

In operation of the bobbin winder machine, operating states can occur in which the yarn does not travel in the region of the yarn braking device of the yarn tensioner. For instance, the yarn may travel next to, in front of or behind the yarn braking device. Since this does not directly affect the rewinding process, this incorrect guidance of the yarn is not always directly detectable, but it does have the disadvantageous aspect that the absence of regulation of the tensile yarn force leads to a defective takeup bobbin, which as a rule is wound too softly.

SUMMARY OF THE INVENTION

It is therefore an object of the invention to provide a method for operating a work station of a cheese-producing textile machine which overcomes the aforedescribed disadvantages of the prior art and by which high winding quality of the takeup bobbins can be assured.

According to the invention, this object is attained by providing a method for operating a work station of a textile machine for producing cross-wound bobbins utilizing a tensile yarn force sensor connected to a work station computer for monitoring the tensile yarn force of a yarn traveling from a supply bobbin to a takeup bobbin, and a yarn tensioner having a yarn braking device for regulating the tensile yarn force. Briefly summarized, the method basically comprises the operation of the work station computer to execute the steps of predetermining a contact pressure of the yarn braking device of the yarn tensioner acting on the yarn according to the tensile yarn force ascertained by the tensile yarn force sensor, comparing the predetermined contact pressure with a predetermined limit value for the contact pressure, and interrupting the bobbin winding process if the limit value is attained or exceeded for a predetermined time period.

Because the contact pressure of a yarn braking device of the yarn tensioner acting on the yarn is predetermined by the work station computer and is constantly compared with a predetermined contact pressure limit value, it can be ascertained immediately if the instantaneous contact pressure has attained or exceeded the predetermined limit value, and if it has done so for a predetermined time period. In this manner, it is reliably assured that each time the limit value is attained or exceeded over a predetermined time period, the reason for which can for instance be defective yarn guidance, this occurrence is detected immediately, and suitable countermeasures can be initiated. This methodology advantageously prevents a takeup bobbin from being wound too softly and thus defectively as a result of an incorrectly guided yarn. Overall, this method increases the effectiveness of the bobbin winding machine, since early corrective measures can be taken immediately when a problem is detected. The method of the invention also assures that all the takeup bobbins produced will have a substantially constant, high bobbin quality, and in particular will be wound with a constant, defined yarn tension.

In a preferred feature of the invention, it is also provided that the contact pressure of the yarn braking device is monitored during a runup of the bobbin to operating speed after a splicing operation in which the upper and lower yarns have been located and automatically joined. As a result, even immediately after approaching the work station, an incorrect guidance of the yarn, particularly in the region of the yarn tensioner, can be detected. Thus, if the yarn is not guided correctly between the brake disks in the yarn tensioner, this occurrence is detected immediately by the work station computer from the attainment or exceeding of a predetermined contact pressure limit value, and a controlled yarn cut is then performed immediately. Thereafter, a predeterminable length of the yarn is unwound from the takeup bobbin and cut off. Finally, after the lower yarn is rejoined to the upper yarn, the bobbin winding process is continued. As a result of this sequence of steps, a quantity of yarn wound incorrectly onto the takeup bobbin because of incorrect yarn guidance advantageously can be removed from the takeup bobbin immediately. This assures a constant quality of the entire takeup bobbin. It can preferably be provided that after repeated response of the contact pressure monitoring in the runup phase, the work station is shut down and a corresponding malfunction signal is generated.

It is also provided in a preferred feature of the invention that the monitoring of the contact pressure of the yarn braking device is performed during the regular bobbin winding process as well. Thus, if the yarn is travelling at a winding speed of up to 2,000 meters per minute (m/min), proper yarn guidance and thus a defined tensile yarn force can be assured by monitoring the contact pressure of the yarn braking device. Once again, if the contact pressure has attained or exceeded a predetermined limit value for a predetermined time period, a controlled yarn cut is made. A malfunction signal is then generated, which indicates the necessity of checking and/or repair of the applicable work station.

Further preferred features, characteristics and advantages of the present invention will be recognized and understood from the following detailed description of an exemplary embodiment shown in the accompanying drawings.

DESCRIPTION OF THE PREFERRED EMBODIMENT

Figure 1:
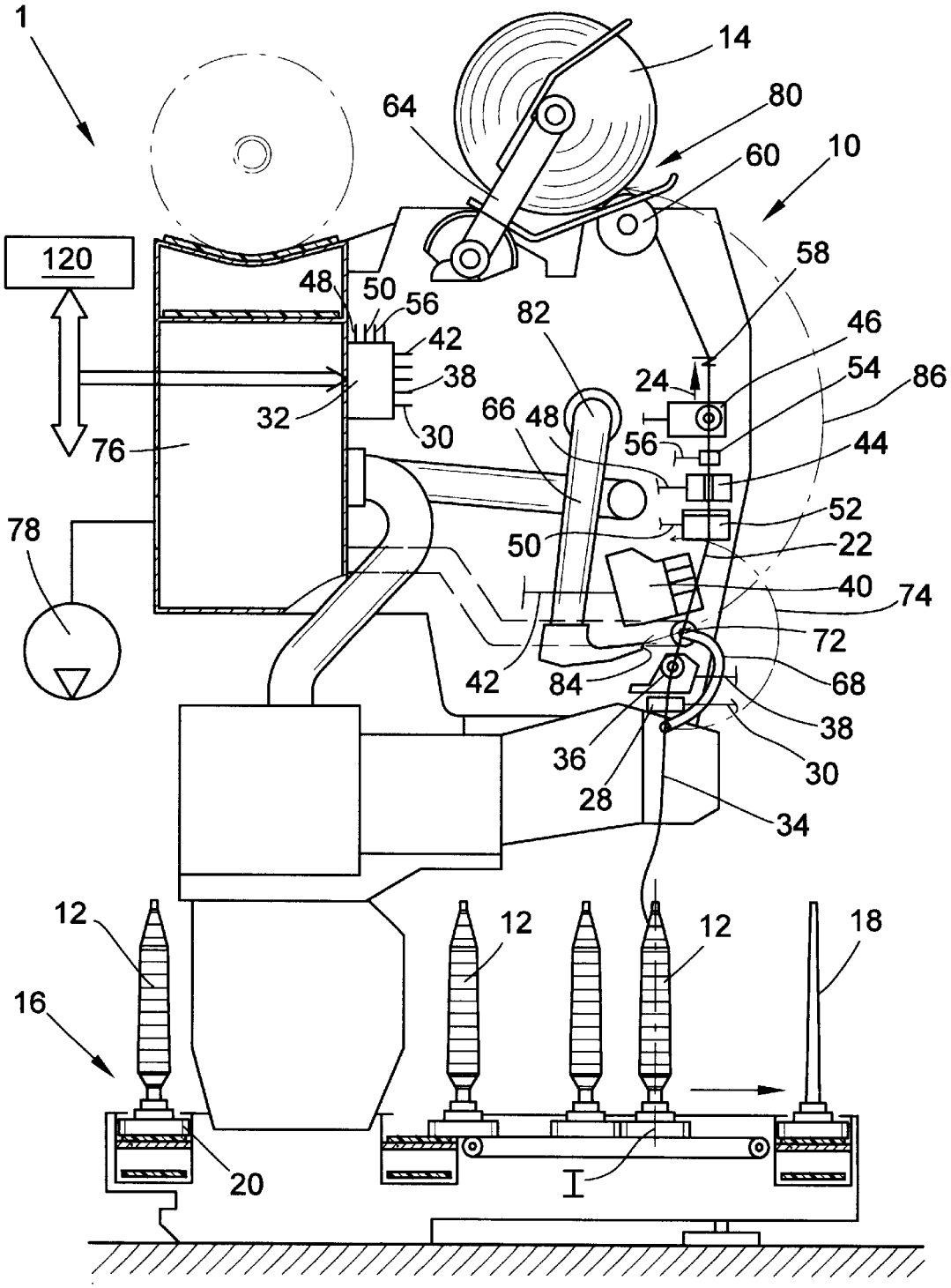
FIG. 1 is a partially schematic side elevation view of a winding station of a cheeseproducing textile machine adapted for performing the method of the present invention.

FIG. 1 shows in a side view a bobbin winding station 10 of a textile machine 1 that produces cross-wound bobbins, also known as cheeses. Such textile machines, known as automatic cheese winders, have many such winding stations (work stations) 10 aligned side by side, at each of which supply bobbins 12 (hereinafter also called spinning cops) are rewound to form large-volume takeup bobbins 14 (hereinafter also called cheeses). The spinning cops 12 are mounted in an upstanding disposition on transport trays 20 which travel via a known transport system 16 to the individual winding stations 10. The transport system 16 has many transport conveyor segments or paths, not identified individually by reference numeral, on which spinning cops 12 or empty tubes 18 are conveyed via the supporting transport trays 20.

In the rewinding operation at each winding station 10, a yarn 22 is drawn from a spinning cop 12 located in the bobbin winding position I. The withdrawn yarn 22 travels from the spinning cop 12 to the cheese 14 in a yarn travel direction 24 along which the yarn first passes a lower yarn sensor 28, which communicates via a signal line 30 with an individual computer 32 associated with the respective work station.

After a yarn break or a controlled yarn cut, this lower yarn sensor 28 ascertains whether any lower yarn 34 (i.e., a leading yarn end from the spinning cop) is present at all, before a search is initiated to locate the upper yarn 80 (i.e., a yarn end trailing from the takeup bobbin).

Figure 2:
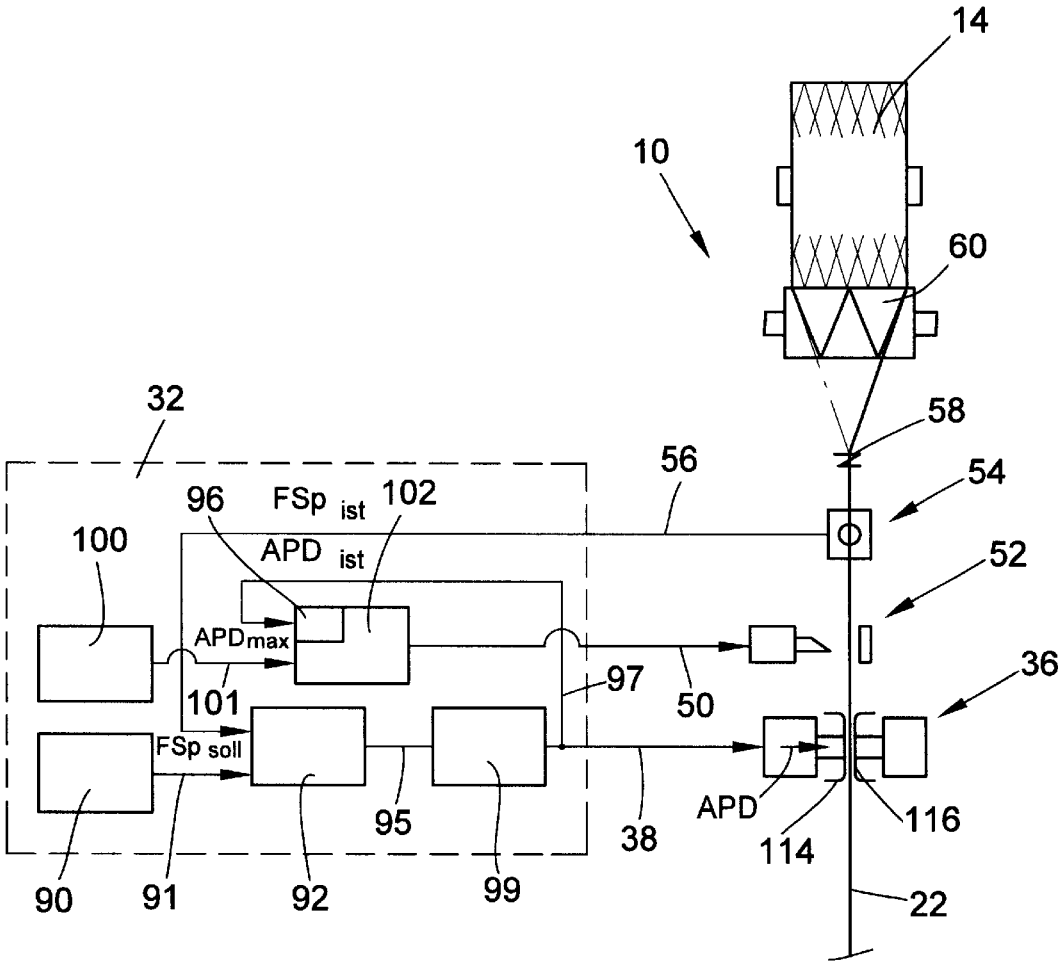
FIG. 2 is a schematic diagram of the work station computer for the winding station of FIG. 1 according to the present invention, wherein the computer is in communication with a tensile yarn force sensor, a yarn tensioner, and a yarn cutting device.
Figure 2:
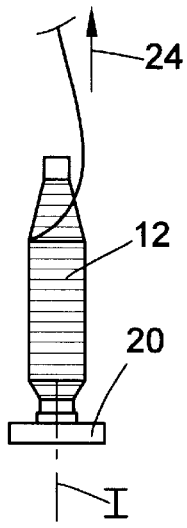

A yarn tensioner 36 is disposed above the lower yarn sensor 28. As indicated in FIG. 2, the yarn tensioner 36 includes two brake disks 114, 116, which exert a contact pressure APD on the traveling yarn 22. To that end, the yarn tensioner 36 is triggered in a defined manner by the work station computer 32 via a control line 38.

A yarn end joining device 40, embodied for instance as a pneumatic splicer, is disposed outside the normal yarn travel path. The splicer 40 also communicates with the work station computer 32, via a signal line 42. A yarn cleaner 44 is disposed in the further course of the yarn travel path, for ascertaining yarn flaws. By means of the yarn cleaner 44, the quality of the running yarn is monitored constantly. The signals of the yarn cleaner 44 are delivered for evaluation to the work station computer 32 over a signal line 48. If a yarn flaw occurs, a cutting device 52 is actuated by the work station computer 32 via a control line 50, and the yarn 22 is severed.

Also disposed downstream of the yarn cleaner 34 in the yarn travel direction 24 are a tensile yarn force sensor 54 and a paraffin applicator 46. The tensile yarn force sensor 54 likewise communicates with the work station computer 32, over a signal line 56.

During bobbin winding operation, the tensile yarn force of the running yarn 22 is monitored constantly by means of the tensile yarn force sensor 54, and the yarn tensioner 36 is triggered via the work station computer 32 in accordance with the tensile yarn force signal $FSp_{ist}$. That is, the brake disks 114, 116 of the yarn tensioner 36 exert a contact pressure $APD_{ist}$ on the yarn 22, which assures that a substantially constant tensile yarn force $FSp_{ist}$ is established in the running yarn 22, which assures a uniform packing density of the cheese 14 to be produced.

The paraffin applicator 46 is finally followed in the yarn travel direction 24 by a yarn guide 58, by which the yarn 22 is directed onto a winding drum 60 or so-called slotted drum, which in turn assures that the yarn 22 is placed crosswise in the type of winding known as "random winding". The cheese 14 is rotatably supported in a pivotably supported creel via a tube, not identified by reference numeral, and rests with the outer peripheral circumference of the cheese against the winding drum 60, which is driven by a single motor and in turn drives the cheese 14 via frictional engagement.

The winding station 10 also has a suction nozzle 66 and a gripper tube 68. The gripper tube 68 serves to grasp the lower yarn end 34, originating at the spinning cop 12, which as a rule is retained in the yarn tensioner 36 in the event of a controlled yarn cleaning cut or if there is a yarn break above the yarn tensioner. The gripper tube 68 is pivotable about a pivot axis 72 and is connected to a central negative pressure supply 76 of the bobbin winding machine 1 which communicates with a negative pressure source 78. The mouth of the gripper tube moves along a path of motion 74 drawn in dashed lines. The pivoting of the gripper tube 68, controlled by the work station computer 32, is effected via a drive device that is known per se and is therefore not shown in detail.

The suction nozzle 66 similarly serves to locate the upper yarn end 80 that typically will have become wound onto the cheese 14 after a yarn break or cut occurs. To that end, the suction nozzle 66 can be pivoted about a pivot axis 82 such that its mouth 84 follows a path of motion 86. The suction nozzle 66 also communicates with the negative pressure supply 76. The pivoting motion of the suction nozzle 66 is actuated via the work station computer 32 by triggering of a drive device that is known per se and thus is not shown, preferably a cam disk package.

The winding station 10 includes further mechanical, electrical and pneumatic components, which will not be described in detail in the context of the present description.

In FIG. 2, the work station computer 32 is shown schematically, along with its interconnection with the yarn tensioner 36, tensile yarn force sensor 54, and yarn cutting device 52. The yarn tensioner 36, shown only very schematically in FIG. 2, is known per se and is described at length for instance in German Patent Disclosure DE 195 26 901 A1. A known device, such as that disclosed in German Patent Disclosure DE 41 29 803 A1, is also preferably used as the tensile yarn force sensor 54.

An electrically triggerable yarn cutting device, of the kind indicated by reference numeral 52, has long been the state of the art in textile machine construction. Such devices as a rule have a cutting blade that can be projected in a targeted manner by means of an electromagnet and is pressed against a stop by supplying current to the electromagnet, thus reliably severing the yarn as it passes past the blade.

In the exemplary embodiment shown, the work station computer 32 has a yarn tension set-point value transducer 90, a contact pressure limit value transducer 100, a closed-loop controller 99, a comparator 92, and a comparator 102 that is equipped with a timer 96. The work station computer 32 communicates with the tensile yarn force sensor 54 over a signal line 56, with the yarn cutting device 52 over a control line 50, and with the yarn tensioner 36 over a control line 38.

As indicated in FIG. 2, the comparator 92 is supplied with the actual tensile yarn force values $FSp_{ist}$ over the signal line 56 and with the set-point tensile yarn force values $FSp_{soll}$ over the signal line 91. The comparator signal generated travels over the signal line 95 to reach the closed-loop controller 99, which via the control line 38 assures that a contact pressure $APD_{ist}$ is present at the yarn tensioner 36 sufficient to assure a constant tensile yarn force $FSp_{ist}$.

The closed-loop controller signal is also output over the line 97 to the comparator 102, which is preferably equipped with a timer 96. The comparator 102 also communicates via a line 101 with a contact pressure limit value transducer 100, and on its output side is connected to the yarn cutting device 52 via the control line 50.

The operation and function of the method of the present invention may thus be understood. During the rewinding process, the yarn 22 unwound from the feed bobbin 12 travels to the takeup bobbin 14, as a rule following a normal path between the brake disks 114, 116 of the yarn tensioner 36. By a defined adjustment of the contact pressure APD of the brake disks 114, 116, it is assured that the yarn 22 will be wound onto the cheese 14 with an at least approximately constant tensile yarn force. The tensile yarn force is monitored over the entire bobbin winding process by the tensile yarn force sensor 54.

In exceptional cases, however, the yarn 22 may not be guided between the brake disks 114, 116, but instead travels in front of, behind or next to the these brake disks. Since the human operators often fail to notice such incorrect guidance of the yarn 22, there is the risk in these cases that, even though the brake disks are positioned with maximum contact pressure, the yarn 22 will be wound up with an undesirably low tensile yarn force, which leads to a takeup bobbin 14 that is defective because it has been wound too softly.

This kind of incorrect guidance of the yarn 22 can occur during normal bobbin winding operation, for instance if the yarn snaps out of place because it has snarled. However, incorrect yarn guidance can also result from improper rethreading of the yarn in a yarn splicing operation after the yarn has been cut or has broken.

According to the invention, the tensile yarn force of the traveling yarn 22 is scanned constantly via the tensile yarn force sensor 54, and the actual tensile yarn force value $FSp_{ist}$ ascertained is compared in the comparator 92 with a set-point tensile yarn force value $FSp_{soll}$, which is specified by a set-value tensile yarn force transducer 90.

On the output side, the comparator 92 communicates with a closed-loop controller, which assures that the requisite contact pressure APD is always present at the yarn tensioner 36. The corresponding closed-loop controller signal, which in each case corresponds to a particular contact pressure $APD_{ist}$ of the brake disks 114, 116 of the yarn tensioner 36, is also applied to a further comparator 102, which is equipped with a timer 96. The comparator 102 also communicates on the input side with a contact pressure limit value 100, which defines the maximum allowable contact pressure $APD_{max}$.

If in its comparison the comparator 102 determines that the actual contact pressure $APD_{ist}$ attains or exceeds the predetermined maximum contact pressure $APD_{max}$ for a predetermined time period $t_2-t_1$, the yarn cutting device 52 is activated via the control line 50, and the traveling yarn 22 is thereby severed.

The work station computer 32 thereupon initiates the following actions as well. Via a drive device, not shown, the creel 64 is immediately lifted from the winding drum 60, which prevents the yarn end (upper yarn end 80) traveling onto the circumferential surface of the cheese 14 from being wound by the winding drum to such an extent that it cannot be located and aspirated again later by the suction nozzle 66. In addition, the cheese 14 is slowed down to a stop by a bobbin brake (not shown). The lower yarn sensor 28 also detects whether a lower yarn end 34 is present. If the signal of the lower yarn sensor 28 is positive, a yarn end joining operation is initiated.

More specifically, the gripper tube 68 is first triggered to pivot downwardly such that its mouth enters the yarn travel path of the yarn 22 and grasps the lower yarn end 34 fixed to the yarn tensioner 36. Next, the gripper tube 68 is pivoted upwardly along its path of motion 74, so that the gripped lower yarn 34 is placed in the splicer 40. Thereafter or at the same time, the location and aspiration of the upper yarn is initiated. To that end, the mouth 84 of the suction nozzle 66 is pivoted upwardly into a position along the circumference of the cheese 14, and the winding drum 60 is driven counter to its takeup winding direction, so that the cheese 14 rotates in reverse. As a result of the negative pressure applied at the mouth 84 of the suction nozzle 66, the upper yarn 80 is picked up from the surface of the cheese 14 and optionally cleaned by means of a yarn cutting and sensor device (not shown) disposed inside the suction nozzle 66, whereby the piece of yarn wound incorrectly, i.e., too softly, onto the cheese 14 is cut and removed by suction. Next, the suction nozzle 66 is pivoted downwardly along its path of motion 86, so that the upper yarn end 80 is likewise placed in the splicer 40. In the process, the suction nozzle 66 not only places the upper yarn 80 into contact with the tensile yarn force sensor 54 but also threads it into the yarn cleaner 44.

Via the control line 42, the splicer 40 is then actuated to join the lower yarn end 34 to the upper yarn end 80. Thereafter, the work station computer 32 initiates the lowering of the creel 64 again so that the cheese 14 comes into contact with the winding drum 60 again, and the bobbin winding process is resumed.

The tensile yarn force (yarn tension) thus occurring at the yarn 22 is immediately detected via the tensile yarn force sensor 54 and transmitted over the signal line 56 as a tensile yarn force signal $FSp_{ist}$, to the work station computer 32, which also performs the above-described monitoring of the contact pressure APD of the yarn tensioner 36. If the work station computer 32 ascertains that a predetermined limit value of the contact pressure is attained or exceeded again for a predetermined time period, then once again a controlled yarn cut is made and then a new yarn splicing operation is begun. If even after the third yarn splicing operation an excessive contact pressure of the yarn tensioner 36 is recorded, then the applicable winding station is deactuated and shut down. A red light or like signal is actuated at the winding station to indicate that manual intervention by the human operator is necessary.

Monitoring of the contact pressure of the yarn tensioner 36 is performed not only during the runup of the work station 10 after a yarn splicing operation, which for instance occurs at a relatively low winding speed of the yarn 22 of 100 meters per minute, but also during normal ongoing bobbin winding in which winding speeds of about 2,000 meters per minute of the yarn 22 may typically be attained. If it is ascertained during normal bobbin winding operation that the contact pressure APD has attained or exceeded a predetermined limit value for a predetermined time period, then once again the work station computer 32 initiates a controlled yarn cut and stoppage of the affected winding station 10 will occur.

Overall, the described monitoring of the contact pressure $APD_{ist}$ of the yarn tensioner 36 assures that defectively (overly softly) wound yarn 22 is detected immediately, and error correction can be initiated immediately. Thus, the method of the invention leads to an assurance of the quality of the cheeses 14 produced by the bobbin winding machine 1.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A method for operating a work station of a textile machine for producing cross-wound bobbins which comprises a tensile yarn force sensor connected to a work station computer for monitoring the tensile yarn force of a yarn traveling from a supply bobbin to a takeup bobbin, and a yarn tensioner having a yarn braking device for regulating the tensile yarn force, the method comprising executing via the work station computer the steps of predetermining a contact pressure of the yarn braking device of the yarn tensioner acting on the yarn according to the tensile yarn force ascertained by the tensile yarn force sensor, comparing the predetermined contact pressure with a predetermined limit value for the contact pressure, and interrupting the bobbin winding process if the limit value is attained or exceeded for a predetermined time period.

2. The method of claim 1, characterized further by performing the predetermining of the contact pressure during a period of runup to operating speed of the work station after a splicing operation.

3. The method of claim 1, characterized further by, upon attaining or exceeding the limit value of the contact pressure for the predetermined time period, executing a controlled yarn cut, unwinding and cutting off a predeterminable length of the yarn from the takeup bobbin, performing a new splicing operation, and then continuing the bobbin winding process.

4. The method of claim 3, characterized further by repeating the method steps at least once, and in the event the limit value of the contact pressure is again attained or exceeded for the predetermined time period, deactuating the work station.

5. The method of claim 1, characterized further by performing the predetermining of the contact pressure during an ongoing normal stage of the bobbin winding process of the work station.

6. The method of claim 1, characterized further by, upon attaining or exceeding the limit value of the contact pressure for the predetermined time period, deactuating the work station.

7. The method of claim 1, characterized in that the predetermined time period is between about one second and about three seconds.

8. The method of claim 7, characterized in that the predetermined time period is about two seconds.

* * * * *